United States Patent [19]

Barnett

[11] Patent Number: 4,531,860

[45] Date of Patent: Jul. 30, 1985

[54] DEEP SEA OIL SALVAGE MEANS

[76] Inventor: Eugene R. Barnett, 6268 Windsor Dr., Indianapolis, Ind. 46219

[21] Appl. No.: 77,388

[22] Filed: Sep. 20, 1979

[51] Int. Cl.[3] ..... E02B 15/04

[52] U.S. Cl. ..... 405/60; 210/923; 405/210

[58] Field of Search ..... 405/60, 210; 166/364; 210/242.1, 923

[56] References Cited

U.S. PATENT DOCUMENTS 3,548,605 12/1970 Paull et al. ..... 405/60
3,653,215 4/1972 Crucet ..... 405/60
3,664,136 5/1972 Laval et al. ..... 405/60
3,745,773 7/1973 Cunningham ..... 405/60

FOREIGN PATENT DOCUMENTS 1544710 4/1979 United Kingdom ..... 405/60

*Primary Examiner*—David H. Corbin
*Attorney, Agent, or Firm*—Robert A. Spray

[57] ABSTRACT

An effective deep sea oil salvage means, having a large flexible sleeve easily towable to the leak site, with means providing it to be deployed over the leak site in the form of a huge collection chamber, and associated pump and valving for the controlled carry-off of oil and/or gas.

8 Claims, 1 Drawing Figure

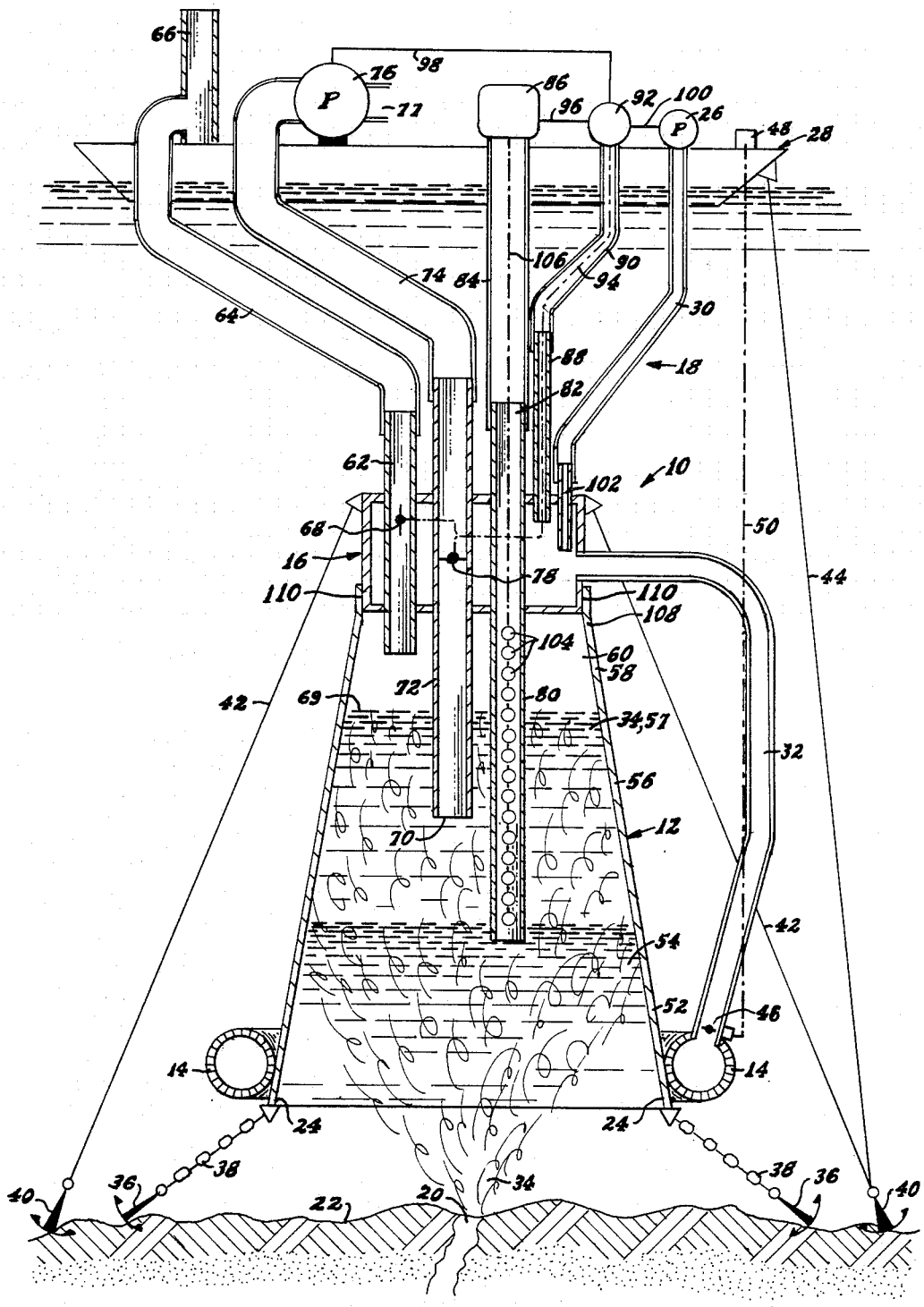
66
98
76
P
77
86
96
92
100
26
P
48
28
106
90
94
74
84
64
30
88
18
82
62
10
102
68
50
16
78
44
110
110
108
104
60
58
42
69
72
80
34,57
32
56
12
70
42
54
52
46
14
14
24
24
38
38
36
36
40
40
22
20
34

DEEP SEA OIL SALVAGE MEANS

This invention relates to oil leaks under water; and concepts of the invention provide new and improved oil recovery means, and quick and relatively convenient deployment thereof, providing maximum savings of oil and the protection of the environment.

In carrying out this invention in an illustrative embodiment, there is provided a huge but flexible sleeve, open at its lower end and anchored to the sea floor over the oil leak. The upper end of the sleeve is closed, and has an arrangement of valved tubes which are operative to pump off oil and vent gases to receiving equipment on the surface. Sensing or control means are provided to control the pumping of oil and valving-off of gases.

The description so far is only of a general and introductory form; and further concepts, details, and advantages will be shown in the following, more detailed description, wherein it will be seen therefrom that several features and concepts combine to provide advantages of sensing, operation, and responsiveness, achieving both goals of saving oil and protecting the environment.

For many years the prior art has struggled against the immense and burdensome problem of salvaging deep sea oil leaks; and it has long been known that such leaks of course waste valuable quantities of oil and/or gas, and the oil causes huge ecological problems as to the environment, both as to the sea water, fouling of beaches, fire, to shipping, wildlife, etc.

The expense of these bad results is staggeringly great; and the cost and danger of trying to cap these deep sea oil leaks is also very great, and it seems that many reported attempts have been relatively unsuccessful.

Great quantities of oil wastage are involved. For example, in the 1979 tragedy of the Mexican oil well leak in the Bay of Campeche, it was reported that the leak was spewing out more than 10,000 barrels of oil daily, and that in less than three months it had dumped over 2,000,000 barrels of oil into the gulf.

The reports of that colossal waste and environmental tragedy also are helpful in understanding the immensity of these problems by expressly describing, as a new attempted method of control, an attempt in which many tens of thousands of two-inch balls (of steel and lead) are forced by a gelatin medium, under high pressure, into the oil tubing, the hope being that a long-continued stream of eight per minute balls will eventually sufficiently clog the damaged wellhead to the extent that the oil-wastage will be reduced to a trickle.

But after using 80,000 of such balls, the oil was still spewing out into the sea, uncontrollably; and the expected blocking effect was still just a wishful hope of the broken line to be brought under control within the relatively long future time of several weeks.

Further as to that well-publicized leak, the reports stated that specially equipped skimmer boats were being used to try to scoop up the floating oil. That ancillary effect is of course costly and no doubt even fraught with significant danger to the salvage boats and their personnel.

From the reports about that particular undersea leak, there must have been a long history of a variety of previous types of undersea capping methods attempted, with non-satisfactory results.

Disaster experts, no doubt at high expense, are flown in from whatever distances necessary to help work on these herculean tasks; and apparently the overall operation takes many weeks of much equipment and manpower.

Even though the prior art has long known of the tremendously great amount of losses and of the varieties of losses involved, and of the tremendously great expenses and other disadvantages in the various types of well-capping or line-capping attempts, none of the methods apparently have satisfactorily succeeded or been effectively improved; and such costly and ineffective methods as the metal-ball and skimmer boat scooping are still being tried, but to no great avail.

There are many particular aspects which contribute to the immensity and difficulty of the repair task. The situs of the oil leak is often many fathoms below the sea surface; the oil itself surfaces and spreads out over great areas of the sea, causing much danger, bother, etc.; the seas may be quite dangerous even though the oil film has some wave-calming effect; the undersea visibility is difficult; etc.

With the brief background, further reminders as to the factors of wastage, cost, danger, pollution, long awareness of the problem, etc., seem unnecessary. The problems have been well publicized, and they have repeatedly occurred over many regions of the world, for many years; and the variety of types of control methods have been generally unsatisfactory and unsuccessful as to many types of these leaks.

Accordingly, with that background of unsuccessful prior art having been set forth, the above-mentioned and other features, objects, concepts, and advantages of the present invention will be further explained and will be apparent from the following description of an illustrative embodiment of the invention, reference being had to the accompanying schematic and generally diagrammatic drawings, in which:

The sole FIGURE of the drawings is a vertical cross-sectional view through the sleeve, and its associated equipment as will now be described, providing a desired embodiment of the overall salvage equipment for an undersea oil leak.

As shown in the drawing, the overall aspects of the invention include several co-operating controls and features. The most conspicuous components of the overall equipment 10 are a huge flexible sleeve means 12, many feet in effective diameter, an inflatable tube 14 encircling the lower portion of the sleeve 12, an undersea tank 16, and various pressure line means 18. These will now be described as to details and as to their function and operativity in the overall system 10.

The flexible sleeve means 12 provides a collection chamber for the oil and/or gas; and when it is towed to the site of the oil leak 20 on the sea floor 22 it is caused to assume an open or generally circular shape by pressuring the tube 14, for the tube 14 is peripherally connected around the sleeve 12 by being connected to the lower edge 24 of the sleeve 12. And when fluid (e.g., air, sea water, or both) is pumped into the tube 14, as by an air pump 26 in the utility ship or barge 28 pumping air through pipe 30 to the submerged tank 16 from which leads a flexible hose 32 to the pressure sleeve or ring 14, that sleeve-tube or ring 14, being of annular-form although flexible, assumes a generally circular shape.

This encircling-ring condition of the tube 14, when it is pressurized, thus forces the connected lower portion 24 of the sleeve 12 to likewise assume an open or generally circular shape, providing an undersea collection chamber for the oil 34 escaping from the oil leak 20, and directly over the situs of the oil leak 20, and downwardly-open in nature.

The flexible sleeve 12 is shown as having affixed of its lower end 24 a plurality of anchors 36; and anchor chains 38, affixed to anchors 36 and to the bottom 24 of the flexible sleeve 12, anchor the assembly to the sea floor 22 over the oil leak 20.

Other anchoring means as shown are anchors 40 connected by anchor chains 42 to the submerged tank 16; and those anchors 40 also help hold the ship or barge 28 in this location by chains 44 extending from the anchors 40 to the ship or barge 28.

For controlling the pressurization of the encircling tube 14, a valve 46 is shown provided in pressure line 32, controlled from the surface by control 48 in the barge 28, and is shown connected to the valve 46 by a control line 50.

When the sleeve 12 has been anchored in its hovering position over the oil-leak site 20, as shown in the drawing, and is in the open-condition shown, the lower end 24 of the sleeve 12 is downwardly-open and receives the oil 34 as it spews from the oil leak 20. Thus in the lower portion 52 of the sleeve 12, there collects a mixture of oil and water as indicated by reference numeral 54.

Above the lower sleeve-portion 52, in which a mixture 54 of oil and water is being collected, a central or intermediate portion 56 of sleeve 12 contains a layer or region 57 of mostly oil 34; and above that is the upper portion 58 of sleeve 12, which contains only gas 60.

The pressurized air tank 16 contains a rigid gas tube 62 which extends downward through tank 16, but non-communicating therewith, into gas pool 60 as illustrated at the top of sleeve 12; and the tube 62 extends upwardly of tank 16, and a flexible gas tube 64 is shown affixed to tube 62. The flexible tube 64 is shown as extending to the barge 28, and to a burn-off tube 66 thereof, to carry unwanted gas to be burned off.

Gas tube 62 has a controlled valve 68 to control pressure of gas in sleeve 12, in order to control the surface 69 of the oil pool 57 in sleeve portion 56 to be higher than the bottom 70 of a rigid oil outlet tube 72. That oil outlet tube 72 extends through tank 16, although non-communicating therewith, and provides the discharge route for the oil 34 through it and through the flexible upper oil-outlet tube 74 connected to tube 72 above the tank 16.

The flexible tube 74 is shown affixed to a variable oil pump 76 contained in barge 28, to pump oil from oil pool 57 contained in portion 56 of the sleeve 12; and the pump 76 pumps oil from line 74 to an associated tanker vessel through line 77.

A variable valve 78, contained in the rigid oil tube 72, is a controlled valve which maintains proper depth of oil 34 in the region 57 of the portion 56 of flexible sleeve 12.

The pressurized air tank 16 contains a rigid sensor tube 80 which extends downwardly through gas pool 60 and oil pool 57 into the water/oil mix pool 54 of sleeve 12. The sensor tube 80 extends upwardly at 82 where a flexible sensor tube 84 is affixed over the tube 82, the flexible tube 84 being shown affixed to sensor instruments 86 contained in the barge 28.

The pressurized air tank 16 contains a rigid control tube 88 which communicates with an extends upward from the pressurized air tank 16 and is attached to a flexible tube 90 which is shown affixed over tube 88. Flexible tube 90 extends to and is affixed to an electric/-pneumatic control unit 92 contained in barge 28. Tubes 88 and 90 carry whatever control wires and tubes 94 there are provided to effect control of valves 68 and 78.

Sensor instruments 86 are schematically indicated as connected by line 96 to the electric/pneumatic controller 92 which controls oil pump 76 by line 98, the air pump 26 by line 100, the gas-outlet valve 68, and the oil outlet valve 78.

The pressurized air tank 16 also contains rigid air tube 102, which extends upward and is affixed to the flexible air tube 30 which extends to air pump 26 on the barge 28. Air is pumped into air tank 16 as needed.

The lower sensor tube 80 is shown as provided with sensor elements 104, spaced at about one foot intervals. The sensor elements 104 sense the height of the three substances (oil/water 54, oil 57, and gas 60) by known technology, e.g., being pH-sensitive, optically-sensitive, or weight-sensitive, etc. Those elements then convey that information, as by line 106 in sensor tubes 80, 82, 84, to the sensor control instruments 86, controlling valves 68 and 78 to maintain the three desired zones 54, 57, and 60.

A particular advantage of the pressure tank 16 providing the top of the collection sleeve 12 is that, being pressurized (by air from air pump 26) it is buoyant and thus holds up the upper end 108 of the sleeve 12 to assure that the sleeve is deployed in its downwardly-open collection chamber form even though it is flexible for convenience of its under-surface transport through the seawater in being positioned to cover the oil leak situs 20. The air under pressure in the tank 16 also provides a convenient source of fluid pressure for circular tube 14.

Further, an advantage of the tank 16 being rigid is that it provides a convenient and rigid supporting mount for the rigid tubes 62, 72, and 80 whose position in extending downwardly into the sleeve 12 is desirably fixed.

The tank 16 is desirably circular, giving a circular form to the upper portion 108 of the sleeve 12 which is connected as at 110 to the tank 16.

It is thus seen that a deep sea oil salvage means, according to the present inventive concepts, provides a desired and advantageous installation yielding the high advantages of a conveniently transportable oil-salvage rigging which may be relatively conveniently positioned over the undersea oil leak, providing an effective means of capturing the leaking oil, with minimal hazards to crew and equipment, relatively low cost, protecting against pollution of several environmental factors, minimizing waste, etc.

Accordingly, it will thus be seen from the foregoing description of the invention according to this illustrative embodiment, considered with the accompanying drawings, that the present invention provides new and useful concepts of a deep sea oil salvage means yielding desired advantages and characteristics of actuation and effectiveness, energy savings, oil savings, safety, environmental protection, etc., thus accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. A self-contained, underwater mounted, portable, positionable, deep sea oil salvage means and separator of oil, gas, and water, comprising, in combination:

a flexible sleeve means, means holding operatively open the lower end of the sleeve means to provide that it is of downwardly-opening nature, anchor means operatively connected to the sleeve means to retain it in the situs of the oil leak and to assure that the sleeve means provides a collection chamber for oil and gas emerging from the leak, sealing means operatively sealing the upper end of the sleeve means, control means for discharging oil and/or gases from the sleeve means to associated receiving means, there being provided buoyant means to hold the upper end of the said sleeve means upwardly, thus providing that the said sleeve means is a downwardly-opening collection chamber, in a combination in which a tube means extends into the upper portion of the sleeve means, and releases gas collected in the sleeve means, in a controlled manner, and including a tube means which extends into the interior of the sleeve means for controlled discharge of oil collected in the sleeve means, and also including a sensor means for detection of the presence of layers or regions of oil/water, of oil, and of gas collected in the sleeve means, and in which control means are provided for automatically controlling the discharge of gas by the gas-releasing tube and the discharge of oil by the oil-discharge tube, the control means being responsive to the said sensor means, thus maintaining the desired layers or regions of oil/water, oil, and gas, respectively in the sleeve means.

2. The invention as set forth in claim 1, in which there is provided a flexible tube means operatively connected peripherally to a lower portion of the flexible sleeve means, and pressure means for supplying fluid under pressure to the said flexible tube means to cause it to get sufficiently rigid that it causes the lower portion of the flexible sleeve means to assume its operatively-open and operatively-circular form in which the lower portion of the sleeve means operatively encircles the situs of an undersea oil leak, the said flexible tube means, when so supplied with fluid under pressure, providing the means holding operatively open the lower end of the sleeve means to provide that it is of downwardly-opening nature, in a combination in which the pressure means includes the said buoyant means which holds the upper end of the sleeve means upwardly, the buoyant means being buoyant by being pressurized by air, and the air pressure of said buoyant means providing the pressure for pressurizing the tube means.

3. This invention as set forth in claim 1, in a combination in which the anchor means are such as to hold the sleeve means spaced from the sea floor in the area of and over the said oil leak situs.

4. The invention as set forth in claim 1, in a combination in which there is provided a submerged rigid body member means adjacent the top of the flexible sleeve means, said rigid body member means including the said buoyant means which hold(s) the upper end of the said sleeve means upwardly; and to the rigid body member means are supportingly connected the gas-releasing tube means, the oil-discharge tube means, and the sensor means.

5. The invention as set forth in claim 4, in a combination in which there are provided flexible tube means respectively leading from the gas-releasing tube means and the oil-discharge tube means to associated receiving means above the surface of the sea.

6. The invention as set forth in claim 4, in a combination in which the rigid body member means is a watertight tank means which serves both to carry the said two tube means and the sensor means, and to carry the control means for regulating the discharge of oil and/or gases from the sleeve means.

7. The invention as set forth in claim 1, in a combination in which the said control means controls the pressure of gas in the sleeve means thereby controlling the surface of the oil layer or region in the sleeve means to be higher than the bottom end of the said tube means which provides for the controlled discharge of oil collected in the sleeve means.

8. The invention as set forth in either of claims 1 or 7, in a combination in which the control means which controls the discharge of oil collected in the sleeve means maintains the desired depth of oil in the region of oil, in the sleeve means, which extends above and below the inlet end of the oil-discharge tube.

* * * * *